US009580938B2

(12) United States Patent
Bendel et al.

(10) Patent No.: US 9,580,938 B2
(45) Date of Patent: Feb. 28, 2017

(54) MOTOR VEHICLE DOOR LOCK

(75) Inventors: Thorsten Bendel, Oberhausen (DE); Claus Töpfer, Sindelfingen (DE)

(73) Assignee: Kiekert Aktiengellshaft, Heiligenhaus (DE)

( * ) Notice: Subject to any disclaimer, the term of this patent is extended or adjusted under 35 U.S.C. 154(b) by 153 days.

(21) Appl. No.: 13/984,589

(22) PCT Filed: Feb. 8, 2012

(86) PCT No.: PCT/DE2012/000114
§ 371 (c)(1),
(2), (4) Date: Sep. 23, 2013

(87) PCT Pub. No.: WO2012/107023
PCT Pub. Date: Aug. 16, 2012

(65) Prior Publication Data

US 2014/0001774 A1 Jan. 2, 2014

(30) Foreign Application Priority Data

Feb. 9, 2011 (DE) ..... 10 2011 010 797

(51) Int. Cl.
*E05C 3/16* (2006.01)
*E05B 77/06* (2014.01)
*E05B 85/24* (2014.01)

(52) U.S. Cl.
CPC ..... *E05B 77/06* (2013.01); *E05B 85/243* (2013.01); *Y10T 292/108* (2015.04)

(58) Field of Classification Search
CPC ..... E05B 77/02; E05B 77/04; E05B 77/06; E05B 77/12; E05B 85/243
(Continued)

(56) References Cited

U.S. PATENT DOCUMENTS 4,382,622 A * 5/1983 Ishikawa ..... E05B 77/12 292/216
5,865,481 A * 2/1999 Buschmann ..... 292/216
(Continued)

FOREIGN PATENT DOCUMENTS

DE 4117110 C1 * 12/1992
DE 197 19 999 11/1998
(Continued)

OTHER PUBLICATIONS

International Search Report corresponding to PCT Application No. PCT/DE2012/000114 mailed Aug. 23, 2012.
(Continued)

*Primary Examiner* — Kristina Fulton
*Assistant Examiner* — Alyson M Merlino
(74) *Attorney, Agent, or Firm* — Renner, Otto, Boisselle & Sklar, LLP

(57) ABSTRACT

The invention relates to a motor vehicle door lock equipped with a locking mechanism (1, 2, 15), an actuation lever unit (3, 4) acting on the locking mechanism (1, 2, 15), and a catch lever (10). The catch lever (10) renders the actuation lever unit (3, 4) ineffective, at least when acceleration forces of a given magnitude occur, e.g. in case of an accident (crash). According to the invention, the catch lever (10) blocks the actuation lever unit (3, 4) during non-deflected normal operation and in the event of a crash while releasing the actuation lever unit (3, 4) only for deflected normal operation.

11 Claims, 1 Drawing Sheet

(58) Field of Classification Search
USPC ..... 292/201, 216, DIG. 22, DIG. 23, 194, 292/195, 198, 200, 217, 336.3, DIG. 65
See application file for complete search history.

(56) References Cited

U.S. PATENT DOCUMENTS

| | | | | |
|---|---|---|---|---|
| 6,971,688 | B2 * | 12/2005 | Drysdale et al. | 292/216 |
| 8,056,944 | B2 * | 11/2011 | Jankowski et al. | 292/216 |
| 8,303,004 | B2 * | 11/2012 | Lee et al. | 292/216 |
| 8,414,038 | B2 * | 4/2013 | Bedekar | E05B 77/04 292/216 |
| 2009/0322105 | A1 * | 12/2009 | Lee | E05B 77/06 292/237 |
| 2010/0283268 | A1 * | 11/2010 | Cumbo | 292/196 |
| 2011/0210565 | A1 * | 9/2011 | Scholz et al. | 292/200 |
| 2014/0035295 | A1 * | 2/2014 | Bendel et al. | 292/100 |
| 2014/0132008 | A1 * | 5/2014 | Bendel et al. | 292/92 |

FOREIGN PATENT DOCUMENTS

| | | | |
|---|---|---|---|
| DE | 199 02 561 | A1 | 8/2000 |
| DE | 19910 513 | A1 | 9/2000 |
| DE | 20 2008 012949 | U1 | 3/2010 |
| DE | 102011010797 | A1 * | 8/2012 |
| DE | 102011010815 | A1 * | 8/2012 |
| DE | 102011010816 | A1 * | 8/2012 |
| WO | 2009/150225 | A2 | 12/2009 |

OTHER PUBLICATIONS

International Preliminary Report on Patentability corresponding to PCT Application No. PCT/DE2012/000114 dated Aug. 13, 2013.

* cited by examiner

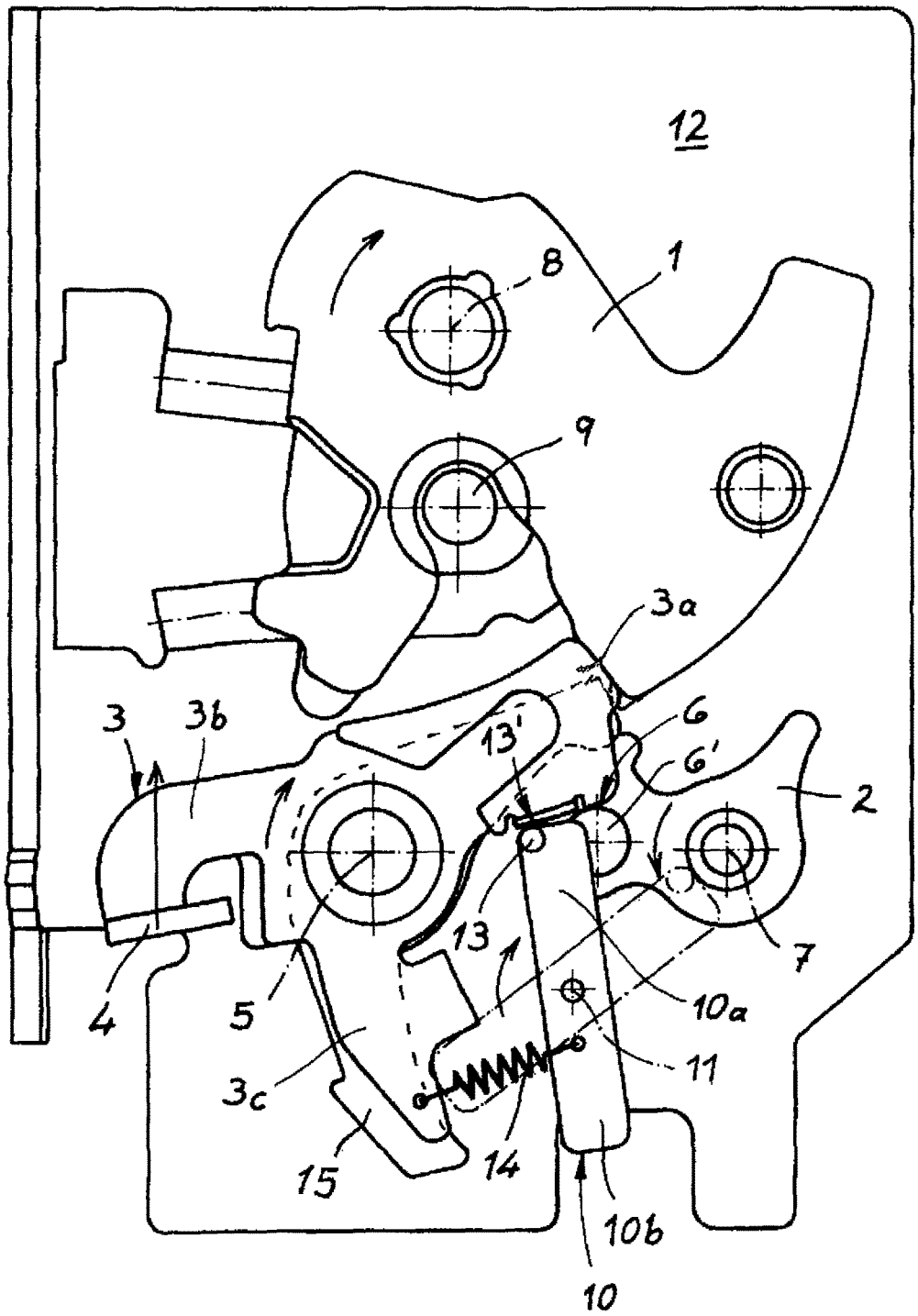
12
8
1
9
3a
3
3b
13'
6
6'
2
13
7
4
5
10a
11
3c
15
14
10b
10

MOTOR VEHICLE DOOR LOCK

The invention relates to a motor vehicle door lock with a locking mechanism, an actuation lever unit acting on the locking mechanism and a catch lever, blocking the locking mechanism at least when acceleration forces of a given magnitude occur, e.g. in case of an accident (crash).

The actuation lever unit generally comprises one or several levers. Normally, the unit contains at least an internal actuating lever, an external actuating lever and a release lever. When the actuation lever unit is acted upon, the locking mechanism can be opened in this way. For this purpose, the release lever typically engages with a pawl of the locking mechanism and lifts it off an associated rotary latch. The rotary latch then opens with the assistance of a spring and releases an engaged locking bolt. As a result, an associated motor vehicle door can be opened.

In case of an accident or in the event of a crash, mentioned above, high acceleration forces generally occur, which can be several times greater than the earth's acceleration. The respective motor vehicle door lock is thus exposed to considerable inertia forces which could cause an unintentional opening of the locking mechanism and thus of the entire associated door lock.

These described scenarios represent considerable hazards for vehicle users. A motor vehicle door opened unintentionally can, for instance, no longer provide any safety devices contained therein, such as a side airbag or side impact protection for the protection of the passengers of the vehicle. For this reason, various measures were already implemented in the past that either block the actuation lever unit or the locking mechanism during occurrence of the described abnormal acceleration forces, e.g. in the event of a crash. In these cases, a so-called inertia lock is used, which is in its rest position under normal operating conditions and is not engaged in the actuation lever unit or the locking mechanism.

A catch lever acting on the actuation lever unit is, for instance, disclosed in DE 197 19 999 A1. The lock or catch lever blocks an opening lever when the described acceleration forces are exerted in case of an accident. For this purpose, the lock or the catch lever and the opening lever are arranged transversely to the swivel direction of the opening lever and are displaceable in relation to each other. In case of a relative displacement caused by increased acceleration forces, the opening lever enters the lock. This aims to prevent unwanted opening in the event of a crash whilst keeping the design simple. A permanent blocking of the opening levers is also generally discussed.

The generic state of the art of DE 19910 513 A1 describes a crash catch on a door lock. This catch contains a pivotable catch lever, which can be pivoted by inertia force around its swivel axis into a blocking position stopping the transmission element.

Also, a counter blocking surface is provided, which is fixed in position.

Not all aspects of the prior art are satisfactory. The systems generally work in that the catch lever blocks the actuation lever unit or locking mechanism only during the occurrence of abnormal acceleration forces, e.g. in the event of a crash. In practical application this can result in incorrect functioning, for instance, in case that the movement of the catch lever is blocked or delayed due to corrosion or ageing, etc. Such functional faults can also not be checked, for instance, as part of maintenance, as the catch lever has to be moved, which is not possible in practical application. The invention aims to remedy this situation.

The invention is based on the technical problem of further developing such a motor vehicle door lock in such a way that functional reliability is increased, whilst keeping the design simple.

To solve this technical problem, a generic motor vehicle door lock of the invention is characterized in that the catch lever in non-deflected normal operation and in the event of a crash, blocks the actuation lever unit and only releases it for non-deflected normal operation.

According to the invention the catch lever thus practically assumes a permanently active position, as the catch lever ensures that the actuation lever unit is blocked in the non-deflected normal operation, e.g. in case that the motor vehicle door lock is resting and the locking mechanism is not deflected and normal acceleration forces act on the motor vehicle door lock.

According to the invention, the catch lever blocks the actuation lever unit in the non-deflected normal operation. The locking mechanism can thus not be opened. The deflected normal operation on the other hand corresponds with the actuation lever unit being released from the catch lever. Consequently, the actuation lever unit can open the locking mechanism in deflected normal operation. In most cases the blocking pawl is actuated for this purpose, after which the retaining pawl is lifted off the rotary latch.

The design of the invention is, in any case, such that the catch lever blocks the actuation lever unit in non-deflected normal operation. The same applies in case of a crash. This means that the catch lever does not even change its relative position in relation to the actuation lever unit in case of a crash. This is mainly due to the fact that the moment of inertia of the catch lever is designed overall in such a way that in the event of a crash, the catch lever retains its position in relation to the actuation lever unit unchanged due to the applied inertia forces. As a result, the actuation lever unit is also reliably blocked in such a case and the locking mechanism cannot be opened inadvertently.

In detail, the catch lever is normally a swivel lever designed to rotate around an axis. In most cases, the catch lever and the locking mechanism are accommodated in a lock case. The same applies at least partly to the actuation lever unit. The lock case provides the aforementioned components and their mounting with the required rigidity and positional accuracy to ensure correct functioning.

The catch lever is generally a two-arm lever consisting of a blocking arm and a compensation arm. In most cases the blocking arm interacts with the actuation lever unit. Typically, the blocking arm abuts the release lever of the actuation lever unit or ensures that it is blocked.

It has shown to be advantageous for the catch lever being coupled to the actuation lever unit. In this way the actuation lever unit provides the control for the catch lever. An elastic coupling has been proven to be particularly advantageous. This is generally provided by a spring, connecting the catch lever and the actuation lever unit. Preferably the respective spring engages in the compensation arm of the catch lever and in any case in such a way that the catch lever releases the actuation lever unit during normal actuation. Generally, the spring is also connected to the release lever as part of the actuation lever unit.

By coupling, on one hand, the catch lever with, on the other hand, the actuation lever unit or release lever it is achieved that in the deflected normal operation the deflected release lever triggers the catch lever. In fact, the pivoting motion of the release lever also ensures that the catch lever is acted upon by the spring and is carried along.

This means that the catch lever blocks the release lever and thus the actuation lever unit in the non-deflected normal operation. The same applies in case of a crash. The catch lever only releases the release lever in the non-deflected normal operation. For this purpose, the catch lever may contain a blocking shape, a cam, a deformation, etc. interacting with the actuation lever unit. The cam or deformation interacts in detail with the release lever, which does or can also contain a cam, a corresponding recess, a counter shape, etc.

It has proven to be advantageous for the catch lever to be assigned to a release arm of the release lever. The release lever contains indeed at least two arms, i.e. the aforementioned release arm as well as an actuation arm. Also, a coupling arm of the release lever may be provided. This means that the release lever contains three arms. One or several more levers or actuation elements of the actuation lever unit engage with the actuation arm of the release lever. The release arm on the other hand acts on the blocking and the retaining pawl, lifting the latter off the rotary latch and opening the locking mechanism as a result. The coupling arm finally provides the elastic connection of the release lever with the catch lever. For this purpose, the aforementioned spring is connected, on one hand, to the coupling arm of the release lever and, on the other hand, to the compensation arm of the catch lever.

The blocking arm of the catch lever is generally arranged against or close to the release arm of the release lever. This applies for the non-deflected normal operation and in case of a crash. The catch lever only rotates during deflected normal operation and mostly in the pivot direction of the release lever. In this way, the catch lever releases the previously blocked release arm and thus the release lever.

To ensure that the catch lever is blocked in case of a crash, the catch lever generally has a moment of inertia preventing its movement. As the release lever is elastically coupled with the catch lever, even a deflection of the release lever in case of a crash does not cause the, catch lever to be "carried along". Instead, the catch lever remains at rest and a deflection of the release lever does not cause a movement of the catch lever. Instead, such movements of the release lever are intentionally permitted by the provided elastic coupling.

At the same time, the design is such that the coupling forces, created by the spring between the release lever and the catch lever do not exceed the inertia forces of the catch lever during a deflection of the release lever.

The overall design is such that the catch lever remains at rest even in the event of a crash.

Any movements of the actuation lever unit or of the release lever coupled with the catch lever do even in this case not cause the catch lever to be deflected. This is because, on one hand, the catch lever blocks the actuation lever unit and, on the other hand, the elastic coupling forces between the release lever and the catch lever are not strong enough for the catch lever to be deflected and the release lever to be released.

During deflected normal operation, on the other hand, the catch lever is rotated in the pivot direction of the release lever. During this process, the catch lever releases the release arm of the release lever. As a result, also the actuation lever unit is released and an operator can, for instance, finally open the locking mechanism via the internal actuating lever and the actuation lever unit.

In the embodiment, the catch lever and its axis are arranged below a connection line of the axes of the release lever on one hand and of the retaining pawl, on the other hand. Also the axes of, on one hand, the catch lever and, on the other hand, the release lever are arranged parallel to each other. This provides for a compact and functional design.

The result is a motor vehicle door lock, which first of all provides a high level of functional reliability, as the catch lever assigned to the actuation lever unit remains at rest during deflected normal operation and in the event of a crash, reliably blocking the actuation lever unit in both cases. This means that the catch lever is permanently active. Only when the catch lever is exposed to low accelerations associated with the deflected normal operation and thus also low acceleration forces, the forces acting on the actuation lever unit ensure that, at the same time, the catch lever is moved from its former blocking into a releasing position. As a result, the actuation lever unit is only released during the non-deflected normal operation.

The actuation lever unit is consequently able to lift the blocking pawl and the retaining pawl off the rotary latch via the release lever. A locking bolt previously retained by the rotary latch is released. The same applies for the motor vehicle door coupled with the locking bolt.

Below, the invention is explained in detail with reference to a drawing for a single embodiment. The FIGURE shows a schematic view of the motor vehicle door lock.

The FIGURE shows a motor vehicle door lock equipped with a locking mechanism 1, 2, 15 consisting of a rotary latch 1, a blocking pawl 2 and a retaining pawl 15. The FIGURE also shows an actuation lever unit 3, 4 acting on the locking mechanism 1, 2, 15. Although not limited to this, the actuation lever unit 3, 4 in the embodiment comprises a release lever 3 and an actuation lever 4. If the actuation lever 4 is pulled in the direction of the arrow, the release lever 3 turns clockwise around its axis 5, as also shown by the arrow in the FIGURE.

During this process, an edge 6 of the release lever 3 engages with a journal 6' of the blocking pawl 2. This causes the blocking pawl 2 to turn counter-clockwise around its axis 7, as indicated by the arrows. As soon as the blocking pawl 2 releases the retaining pawl 15, the retaining pawl 15 can be lifted off the rotary latch 1 and the rotary latch 1 can be turned by the spring around its axis 8 as shown in the FIGURE. As a result, a locking bolt 9 is released, which is only indicated in the FIGURE. The locking bolt 9 is connected to a motor vehicle door, not shown, which can thus be opened. This corresponds with the deflected normal operation.

A further part of the fundamental design is a catch lever 10, rotatably mounted on an axis 11. Axis 8 of the rotary latch 1, axis 7 of the retaining pawl 2, axis 5 of the retaining pawl 15 and of the release lever 3 and finally axis 11 of the catch lever 10 are all defined in a lock case 12. Also, all aforementioned axes 7, 8, 5 and 11 may be arranged in parallel to each other. This can also be bearing journals, mainly extending perpendicularly from a base plane of the lock case 12. This is naturally only an example and does not restrict the scope of the invention in any way.

The catch lever 10 is a swivel lever 10, arranged to rotate around its own axis 11. The catch lever 10 and the locking mechanism 1, 2, 15 are both mounted in the lock case 12. The same applies for the release lever 3. The catch lever 10 is a two-arm lever consisting of a blocking arm 10*a* and a compensation arm 10*b*.

The blocking arm 10*a* is arranged on or closely to a release arm 3*a* of the release lever 3. This applies, in any case, for the non-deflected normal operation shown as the only solid line in the FIGURE and in case of a crash.

Apart from the release arm 3*a*, the release lever 3 also contains an actuation arm 3*b* and finally a coupling arm 3*c*.

Whilst the release arm 3*a* interacts with the blocking pawl 2 via the aforementioned edge 6 and the journal 6' and is in operative connection with the retaining pawl 15 via actuation elements, not shown, the further actuation lever 4 or another additional actuation element of the actuation lever unit 3, 4 is connected to the actuation arm 3*b*. The coupling arm 3*c*, on the other hand, provides a coupling or connection between the release lever 3, on one hand and the catch lever 10, on the other hand.

Whilst the blocking arm 10*a* of the catch lever 10 faces the release lever 3 or its release arm 3*a*, the blocking arm 10*a* of the catch lever 10 may contain a recess, a cam 13, etc., engaging with an edge 13' of the release lever 3 or primarily interacting with this edge 13'. Naturally, also the reverse arrangement is possible. In this case, the catch lever 10 contains said edge 13', whilst the release lever 3 contains cam 13. Naturally, the invention can also provide for different types with two cams, a cam and counter-cam, a cam and a recess, etc.

In any case, the catch lever 10 indicated in the FIGURE by a solid line, ensures that the actuation lever unit 3, 4 is blocked during non-deflected normal operation. The same applies in case of a crash. The catch lever 10 only releases the actuation lever unit 3, 4 during deflected normal operation, as explained in more detail below.

It is apparent that in the embodiment, the respective axes 5, 7 of the release lever 3 and the blocking pawl 2 are arranged along a connecting line. The catch lever 10 and its axis 11 are located below the connecting line of the two axes 5, 7. The catch lever 10 does thus have an arrangement below a connecting line in form of the two axes 5, 7. Of further significance is the circumstance that the catch lever 10 is elastically coupled with the actuation lever unit 3, 4. This is ensured by the spring 14. In the embodiment, the spring 14 engages, on one hand, with the compensation arm 10*b* of the catch lever 10 and, on the other hand, with the coupling arm 3*c* of the release lever 3. The spring 14 provides a connection between the catch lever 10 and the release lever 3 and thus the actuation lever unit 3, 4, which is elastic.

In this way, the invention or the catch lever 10 is able to block the release lever 3 in the non-deflected normal operation and in case of a crash. The catch lever 10 releases the release lever 3 and thus the actuation lever unit 3, 4 only during deflected normal operation. For this purpose, the catch lever 10 is assigned to the release arm 3*a* of the release lever 3. The blocking arm 10*a* of the catch lever 10 is actually arranged on or close to the already actuated release arm 3*a* of the release lever 3. This applies, in any case, for the non-deflected normal operation and in case of a crash.

In all these scenarios, the catch lever 10 remains at rest. During non-deflected normal operation this is immediately apparent, as the actuation lever unit 3, 4 is not acted upon by an operator and the motor vehicle door lock is, at most, only exposed to low acceleration forces. In the event of a crash, however, the already described increased and abnormal acceleration forces act on the catch lever 10 and naturally on the entire motor vehicle door lock. Because of the inertia moments of the catch lever 10, the design of the catch lever ensures that even in case of a crash, the catch lever 10 does not leave its position shown by the solid line. Thus also in case of a crash, the catch lever 10 continues to block the release lever 3 and thus the actuation lever unit 3, 4 in its entirety. Even, where in the event of such a crash the release lever 3 is moved (slightly) around its axis 5, this pivoting motion cannot change the retained position of the catch lever 10.

This is as the coupling forces produced in this context by the spring 14 are too low to carry along the catch lever 10. The catch lever 10 consequently counteracts any movement of the release lever 3 and thus of the actuation lever unit 3, 4 by blocking them in case of a crash.

When, however, only normal acceleration forces act on the shown motor vehicle door lock and normal operation prevails, the catch lever 10 can be deflected by the actuation lever unit 3, 4 being acted on. This consequently includes the deflected normal operation. In this case, the fact that the actuation lever unit 3, 4 is acted on, thus causing the associated described clockwise rotation of the release lever 3 around its axis 5, actually ensures that the catch lever 10 rotates in the same pivot direction of the release lever. This means that the clockwise motion of the release lever 3 around the axis 5 causes the catch lever 10 to also rotate in the same pivot direction, i.e. carrying out a clockwise turn around its axis 11 in the same manner. This is indicated by an arrow in the only FIGURE. At the end of this process, the catch lever 10 assumes its dashed position again, corresponding to the deflected normal operation.

In contrast to the non-deflected normal operation and in case of the crash, the cam 13 of the catch lever 10 does not (does no longer) face the edge 13' on the release lever 3 or abut against this edge 13' thus blocking the actuation lever unit 3, 4. Instead the deflected normal operation of the catch lever 10, shown by the dashed line, causes the cam 13 of said catch lever 10 to be released from said edge 13' or releases the edge 13'. In this way, the release lever 3 can continue its clockwise movement around axis 5 and is not blocked by blocking lever 10 during this process.

As a result, the edge 6 is brought into operative connection with the journal 6' on the blocking pawl 2. The blocking pawl 2 is consequently moved out and the retaining pawl 15 can be lifted off the rotary latch 1. The rotary latch 1 opens with the aid of the spring by carrying out a clockwise movement around axis 8. The previously retained locking bolt 9 is released. The same applies for the motor vehicle door, not shown.

In a further embodiment, not shown, the catch lever 10 acts on the retaining pawl 15 of a locking mechanisms 1, 15, not containing a blocking pawl 2, in the described manner, with the release lever 3 acting directly on the retaining pawl 15.

The invention claimed is:

1. A motor vehicle door lock, equipped with a locking mechanism, an actuation lever unit that acts on the locking mechanism, and a catch lever arranged to block the actuation lever unit at least when acceleration forces of a given magnitude occur during a crash, wherein the catch lever is arranged to block the actuation lever unit during both a non-deflected normal operation and a crash, and the catch lever is configured only to release the actuation lever unit during a deflected normal operation, wherein the catch lever contains a blocking contour that interacts against an opposing surface of the actuation lever unit during both the non-deflected normal operation and a crash to prevent movement of the actuation lever unit.

2. A motor vehicle door lock according to claim 1, wherein the catch lever is designed as a swivel lever rotatable around an axis.

3. A motor vehicle door lock according to claim 1, wherein the catch lever is designed as a two-arm lever consisting of a blocking arm and a compensation arm.

4. A motor vehicle door lock according to claim 1, wherein the catch lever is coupled with the actuation lever unit.

5. A motor vehicle door lock according to claim 4, wherein an elastic coupling is provided by a spring.

6. A motor vehicle door lock according to claim 1, wherein the catch lever is connected to a release lever of the actuation lever unit.

7. A motor vehicle door lock according to claim 1, wherein the catch lever blocks a release lever of the actuation lever unit during the non-deflected normal operation and a crash, and the catch lever only releases the release lever during the deflected normal operation.

8. A motor vehicle door lock according to claim 7, wherein the catch lever is assigned to a release arm of the release lever.

9. A motor vehicle door lock according to claim 8, wherein a blocking arm of the catch lever is arranged on or in close proximity to the release arm of the release lever during the non-deflected normal operation and a crash.

10. A motor vehicle door lock according to claim 8, wherein during the deflected normal operation, the release lever rotates in a pivot direction and the catch lever rotates in the same pivot direction as the release lever so as to release the rotation of the release arm of the release lever during this process.

11. A motor vehicle door lock according to claim 1, wherein the catch lever maintains the same position during both the non-deflected normal operation and a crash.

* * * * *